US006255780B1

(12) United States Patent
Komaki et al.

(10) Patent No.: US 6,255,780 B1
(45) Date of Patent: Jul. 3, 2001

(54) PLASMA DISPLAY PANEL

(75) Inventors: Toshihiro Komaki; Hitoshi Taniguchi; Tatsuro Sakai, all of Yamanashi-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/294,138

(22) Filed: Apr. 20, 1999

(30) Foreign Application Priority Data

Apr. 21, 1998 (JP) ..... 10-126893

(51) Int. Cl.[7] ..... H01J 11/02
(52) U.S. Cl. ..... 313/586; 313/587
(58) Field of Search ..... 313/586, 587, 313/583, 584; 345/41, 60

(56) References Cited

U.S. PATENT DOCUMENTS 5,742,122 * 4/1998 Amemiya et al. ..... 313/586 X
5,952,782 * 9/1999 Nanto et al. ..... 313/587 X
5,977,708 * 11/1999 Amatsu et al. ..... 313/586 X

* cited by examiner

*Primary Examiner*—Ashok Patel
(74) *Attorney, Agent, or Firm*—Arent Fox Kintner Plotkin & Kahn, PLLC

(57) ABSTRACT

A plasma display panel has a pair of substrates including a display side substrate and a back side substrate, a pair of opposed row electrodes disposed inside the display side substrate interposing a discharge gap, each of the row electrodes comprising a transparent conductive film and a metallic film formed on the transparent conductive film at a position opposite to the discharge gap, a dielectric layer covering the row electrodes. The dielectric layer includes a first dielectric layer formed on the inner surface of the display side substrate, a second dielectric layer formed on the first dielectric layer except the discharge gap and a third dielectric layer formed on the first and second dielectric layers.

2 Claims, 2 Drawing Sheets

PLASMA DISPLAY PANEL

BACKGROUND OF THE INVENTION

The present invention relates to a plasma display panel (PDP) of an AC driven surface discharge type.

Recently, there is expectation of realization of the AC driven surface discharge type PDP as a large and thin color display.

FIG. 4 shows a conventional PDP of the AC driven surface discharge type. The PDP comprises a pair of front and back glass substrates 11 and 12 disposed opposite to each other, interposing a discharge space 18 therebetween. The glass substrate 11 as a display side has a plurality of row electrodes X and Y which are alternately disposed in pairs to be parallel with each other at the inside portion thereof. Each of the row electrodes X and Y comprises a transparent conductive film 13*a* formed by an ITO having a large width and a metallic film 13*b* formed by a metallic film having a small width and layered on the transparent conductive film 13*a* for compensating the conductivity of the film 13*a*. The row electrodes X and Y are covered by a dielectric layer 14.

A projected dielectric layer 14*a* is provided opposite to the metallic film 13*b* on the opposite side of the dielectric layer 14. The projected dielectric layer 14*a* is provided for preventing error discharge in an adjacent discharge cell. A protection layer 15 made of MgO is coated on the dielectric layer 14. On the glass substrate 12, a plurality of data electrodes 16 are formed to intersect the row electrodes X and Y on the glass substrate 11. A fluorescent layer 17 covers the data electrodes 16. The discharge space 18 is filled with rare gas.

A plurality of partition ribs (not shown) are provided between the data electrodes 16. Thus, a pixel cell is formed at the intersection of the row electrodes in pairs and the data electrode defined by a pair of ribs.

The dielectric layer 14 and 14*a* are formed by applying glass paste including a lead, for example lead oxide (PbO), and having a low melting point on the X, Y electrodes and by baking it. The metallic film 13*b* is formed by aluminum, aluminum alloy, silver or silver alloy, because the film is required to have a low resistance to compensate the conductivity of the transparent conductive film.

In the conventional PDP, the glass material used in the projected dielectric layer 14*a* or the baking condition of the projected dielectric layer is limited because of the disposition under the dielectric layer 14.

More particularly, in order to increase the transmissibility of the dielectric layer, a glass having a low melting point is used and is baked at a sufficiently high temperature. However the fluidity of the projected dielectric layer 14*a* increases because of the disposition under the dielectric layer 14. It is difficult to form the projected dielectric layer into a predetermined shape consequently. In addition, the glass material acts with the electrodes during the baking to generate bubbles in the dielectric layer. The bubbles decrease the pressure resistibility, which may cause dielectric brake down.

SUMMARY OF THE INVENTION

An object of the present invention is to provide a plasma display panel in which the transmissibility of the dielectric layer is increased, thereby increasing the reliability of the display panel.

According to the present invention, there is provided a plasma display panel having a pair of substrates comprising a display side substrate and a back side substrate, a pair of opposed row electrodes disposed inside the display side substrate interposing a discharge gap, each of the row electrodes comprising a transparent conductive film and a metallic film formed on the transparent conductive film at a position opposite to the discharge gap, a dielectric layer covering the row electrodes, and a plurality of partitions formed on the back side substrate, intersecting with the row electrodes to form a plurality of pixel cells between the substrates.

The dielectric layer comprises a first dielectric layer including a first glass material and continuously formed on the inner surface of the display side substrate by baking the first glass material, a second dielectric layer including a second glass material, and formed on the first dielectric layer except the discharge gap and continuously formed along the partition by baking the second glass material, and a third dielectric layer including a third glass material formed on the first and second dielectric layers by baking the third glass material at a temperature sufficiently higher than a melting point of the third glass material.

The third glass material has a melting point lower than those of the first and second glass materials.

The present invention further provides a method for making a plasma display panel having a pair of substrates comprising a display side substrate and a back side substrate, a pair of opposed row electrodes disposed inside the display side substrate interposing a discharge gap, each of the row electrodes comprising a transparent conductive film and a metallic film formed on the transparent conductive film at a position opposite to the discharge gap, a dielectric layer covering the row electrodes, and a plurality of partitions formed on the back side substrate, intersecting with the row electrodes to form a plurality of pixel cells between the substrates.

The method comprises forming a first dielectric layer including a first glass material on the inner surface of the display side substrate by baking the first glass material, forming a second dielectric layer including a second glass material on the first dielectric layer except the discharge gap and continuously forming along the partition, and forming a third dielectric layer including a third glass material on the first and second dielectric layers by baking the third glass material at a temperature sufficiently higher than a melting point of the third glass material.

The third glass material has a low melting point than those of the first and second glass materials, and is formed by baking at a temperature sufficiently higher than the melting point thereof.

These and other objects and features of the present invention will become more apparent from the following detailed description with reference to the accompanying drawings.

DETAILED DESCRIPTION OF THE PREFERRED EMBODIMENT

Figure 1:
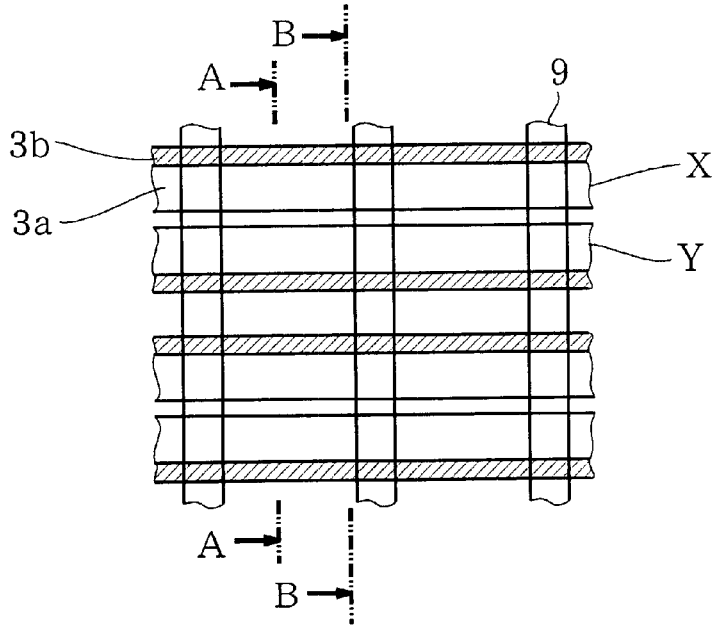
FIG. 1 is a plan view of a part of a display panel of the present invention.
Figure 2:
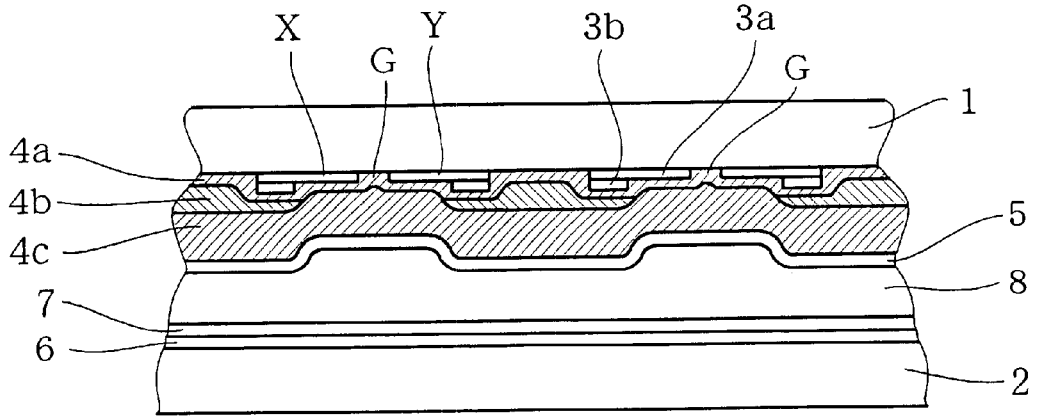
FIG. 2 is a sectional view taken along a line A—A of FIG.

Referring to FIGS. 1 and 2, a pair of display side and back side glass substrates 1 and 2 are disposed opposite to each other, interposing a discharge space 8 therebetween. The glass substrate 1 as a display side has a plurality of row electrodes X and Y which are alternately disposed in pairs. Each of row electrodes X and Y comprises a transparent conductive film 3*a* made of ITO and a metallic film 3*b*.

The metallic film 3*b* is disposed opposite to a discharge gap G between the electrodes X and Y. The transparent conductive film 3*a* is electrically connected to the metallic film 3*b*.

On the back side glass substrate 2, a plurality of data electrodes 16 are formed to intersect the row electrodes X and Y on the display side glass substrate 1.

A plurality of partition ribs 9 are provided, intersecting with row electrodes to form a pixel cell. The row electrodes X and Y are covered by a first dielectric layer 4*a*.

Figure 3:
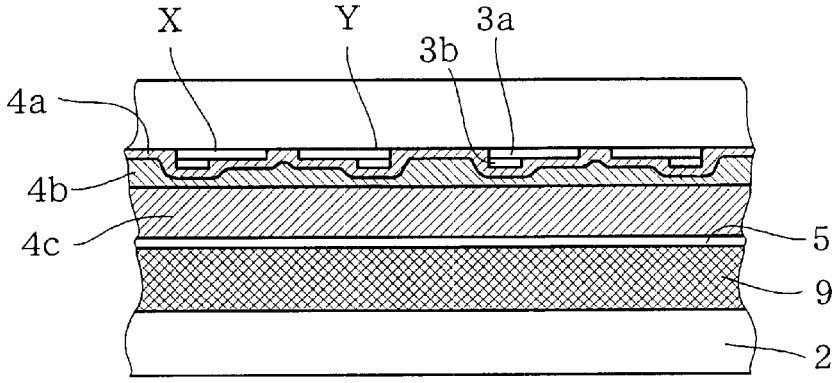
FIG. 3 is a sectional view taken along a line B—B of FIG. 1.
Figure 4:
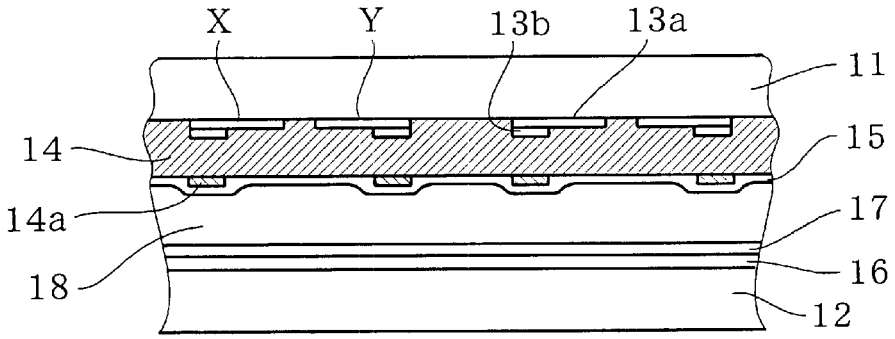
FIG. 4 is a sectional view of a conventional PDP.

A second dielectric layer 4*b* is formed on the first dielectric as shown in FIG. 3. As shown in FIG. 2, the second dielectric layer 4*b* is formed except the discharge gap G, projecting from the surface of the first dielectric layer 4*a*. Furthermore, a third dielectric layer 4*c* is formed to cover the first dielectric layer 4*a* and the second dielectric layer 4*b*.

A protection layer 5 made of MgO is coated on the third dielectric layer 4*c*. A fluorescent layer 7 covers the data electrodes 6. The discharge space 8 is filled with rare gas. Thus, a pixel cell is formed at the intersection of the row electrodes in pairs and the data electrode.

As shown in FIG. 3, the second dielectric layer 4*b* is continuously formed along the rib 9, so that there is not formed a hole communication adjacent pixel cells. Thus, error discharge in the adjacent pixel cell in prevented.

In the PDP of the present invention, the first dielectric layer 4*a* is formed as an underlayer by baking a glass material at a temperature close to the melting point of the glass material. The second dielectric layer 4*b* is formed opposite to the metallic film 3*b* by baking the glass material at a temperature close to the melting point thereof. The glass material of the third dielectric layer 3*c* has a melting point lower than that of the glass material of the first and second dielectric layers 4*a* and 4*b*. The third dielectric layer 4*c* is formed by baking the glass material at a sufficiently higher temperature than the low melting point. Thus, the transmittance of the third dielectric layer 4*c* is increased, and the projected sectional shape of the second dielectric layer 4*b* can be held at a predetermined shape.

The transparent conductive film 3*a* is formed on the display side glass substrate 1 by the evaporation of ITO or lead oxide at a thickness of several thousand angstrom. The metallic film 3*b* is formed on the transparent conductive film 3*a* by the evaporation of aluminum, aluminum alloy, silver or silver alloy at a smaller width than the conductive film 3*a* in parallel with the film 3*a*, in order to increase the conductivity of the conductive film 3*a*. Thus, the row electrodes X and Y are formed.

The first dielectric layer 4*a* is formed to cover the row electrodes X and Y by applying a glass paste including a first glass material having a melting point higher than 580° C., and by baking the glass paste at a temperature close to the melting point, for example 560° C.–600° C., as an underlayer.

Next, the second dielectric 4*b* is formed on the first dielectric layer 4*a*, opposite to the metallic film 3*b* and along the rib 9 by applying a glass paste including a second glass material having a melting point equal to the first glass material or slightly lower than the first glass material, for example 550° C.–580° C., and by baking it at a temperature close to the melting point (530° C.–600° C.).

Thus, the second dielectric layer 4*b* is formed on the first dielectric layer 4*a* to be projected at the position opposite to the metallic film 3*b*.

Next, the third dielectric layer 4*c* is formed on the first and second dielectric layers 4*a* and 4*b* by applying by a glass paste including a third glass material having a melting point sufficiently lower than the first or second glass material, for example 460° C.–480° C., and by baking it at a sufficiently higher temperature (560° C.–600° C.).

The protection layer 5 of magnesium oxide is formed on the third dielectric layer 4*c* at a thickness of about several thousand angstrom.

On the back side glass substrate 2, a plurality of data electrodes 6 are formed, intersecting with the row electrodes. The data electrode 6 consists of aluminum or aluminum alloy and has a thickness of about 1 $\mu$m.

In addition, the fluorescent layer 7 is formed on the data electrodes 6.

The display side glass substrate 1 and the back side glass substrate 2 are shielded, the surface of the protection layer 5 is activated by baking. The air in the discharge space 8 is discharged, then the discharge space 8 is filled with a rare gas for example an inactive mixed gas (200–600 torr) including xenon.

In a color display panel, each pixel cell is excited to emit light of a color corresponding to one of three colors of fluorescent substances.

In accordance with the present invention, the dielectric layer comprises a first dielectric layer formed as an underlayer, a second dielectric layer formed opposite to a metallic film, and a third dielectric layer, so that bubbles which cause the pressure resistibility are prevented from generating. The glass material of the third dielectric layer has a melting point lower than that of the glass material of the first and second dielectric layers. The third dielectric layer is formed by baking the glass material at a sufficiently higher temperature than the low melting point. Thus, the transmittance of the third dielectric layer is increased, and the projected sectional shape of the second dielectric layer can be held at a predetermined shape. Consequently, the reliability of the PDP is increased.

While the invention has been described in conjunction with preferred specific embodiment thereof, it will be understood that this description is intended to illustrate and not limit the scope of the invention, which is defined by the following claims.

What is claimed is:

1. A plasma display panel having a pair of substrates comprising a display side substrate and a back side substrate, a pair of opposed row electrodes disposed inside the display side substrate interposing a discharge gap, each of the row electrodes comprising a transparent conductive film and a metallic film formed on the transparent conductive film at a position opposite to the discharge gap, a dielectric layer covering the row electrodes, and a plurality of partitions formed on the back side substrate, intersecting with the row electrodes to form a plurality of pixel cells between the substrates, wherein the dielectric layer comprises;

a first dielectric layer including a first glass material and continuously formed on the inner surface of the display side substrate by baking the first glass material, a second dielectric layer including a second glass material, and formed on the first dielectric layer at least one area selected from an area opposite to the metallic layer, an area opposite to an area between the metallic layer, and an area opposite to the partition by baking the second glass material, and a third dielectric layer including a third glass material formed on the first and second dielectric layers by baking the third glass material at a temperature sufficiently higher than a melting point of the third glass material.

2. The plasma display panel according to claim 1 wherein the third glass material has a melting point lower than those of the first and second glass materials.

* * * * *